US011579548B2

(12) United States Patent
Usami

(10) Patent No.: US 11,579,548 B2
(45) Date of Patent: Feb. 14, 2023

(54) TEMPERATURE CONTROL APPARATUS AND IMAGE FORMING APPARATUS

(71) Applicant: TOSHIBA TEC KABUSHIKI KAISHA, Tokyo (JP)

(72) Inventor: Yutaka Usami, Izunokuni Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/407,581

(22) Filed: Aug. 20, 2021

(65) Prior Publication Data

US 2022/0187744 A1 Jun. 16, 2022

(30) Foreign Application Priority Data

Dec. 16, 2020 (JP) ..... JP2020-208437

(51) Int. Cl.
*G03G 15/20* (2006.01)
*G03G 15/00* (2006.01)

(52) U.S. Cl.
CPC ..... *G03G 15/2039* (2013.01); *G03G 15/5004* (2013.01)

(58) Field of Classification Search
CPC ..... G03G 15/2039; G03G 15/5004
See application file for complete search history.

(56) References Cited

U.S. PATENT DOCUMENTS

2017/0090396 A1* 3/2017 Kosaka ..... G03G 15/5004
2018/0253040 A1* 9/2018 Tamaki ..... G03G 15/2003
2020/0218183 A1* 7/2020 Shibuya ..... G03G 15/2039

FOREIGN PATENT DOCUMENTS

JP S63202776 A 8/1998
JP 2008145788 A 6/2008

* cited by examiner

*Primary Examiner* — Clayton E. LaBalle
*Assistant Examiner* — Michael A Harrison
(74) *Attorney, Agent, or Firm* — Kim & Stewart LLP

(57) ABSTRACT

According to one embodiment, a temperature control apparatus supplies power to a heater to control temperature of a temperature control target. The temperature control apparatus includes a temperature estimation unit to estimate a temperature of a temperature control target based on electrical power supplied to the heater. The temperature control apparatus also includes control signal generation unit that calculates a duty value for the heater based on an estimated temperature from the temperature estimation unit, a detected temperature from a temperature sensor, and a target temperature for the temperature control target. A pulse signal for controlling the electrical power supplied to the heater is generated based on the calculated duty value.

16 Claims, 9 Drawing Sheets

Table(0)=00000000000000000000=DUTY 0%

Table(1)=00000000010000000000=DUTY 5%

Table(2)=00000100000000010000=DUTY 10%

• • •

Table(9)=10101010101010101010=DUTY 50%

• • •

Table(19)=11111111111111111111=DUTY 100%

TEMPERATURE CONTROL APPARATUS AND IMAGE FORMING APPARATUS

CROSS-REFERENCE TO RELATED APPLICATION

This application is based upon and claims the benefit of priority from Japanese Patent Application No. 2020-208437, filed on Dec. 16, 2020, the entire contents of which are incorporated herein by reference.

FIELD

Embodiments described herein relate generally to a temperature control apparatus and an image forming apparatus.

BACKGROUND

An image forming apparatus includes a fixing device that fixes a toner image onto a printing medium by applying heat and pressure to the printing medium. The fixing device includes a fixing rotating body (heat roller), a pressing member (pressing roller), a heating element (a lamp, an induction heater, or the like), and a temperature sensor. The temperature sensor detects the temperature of the surface of the heat roller.

A controller for controlling the fixing device increases or decreases the amount of electrical power to a heater based on a signal from the temperature sensor (temperature sensor signal) to perform control the surface temperature of the heat roller will be a target value.

If a deviation (or a time lag) occurs between a temperature detected by the temperature sensor and the surface temperature of the heat roller, there is a possibility that overshoot, a temperature ripple, or the like will occur. For this reason, a temperature sensor (for example, a thermopile, thermocouple or the like) having good responsiveness is required to prevent overshoot and a temperature ripple from occurring. However, there is a problem in that a temperature sensor having good responsiveness is generally expensive.

DETAILED DESCRIPTION

An exemplary embodiment provides a temperature control apparatus and an image forming apparatus which are capable of preventing overshoot and a temperature ripple from occurring without substantial increase in cost.

In general, according to one embodiment, a temperature control apparatus includes a temperature estimation unit that is configured to estimate a temperature of a temperature control target based on electrical power supplied to a heater configured to heat the temperature control target. Temperature control apparatus also includes a control signal generation unit configured to calculate a duty value for the heater based on an estimated temperature of the temperature control target received from the temperature estimation unit, a detected temperature of the temperature control target from a temperature sensor, and a target temperature for the temperature control target, and to output a pulse signal for controlling the electrical power supplied to the heater. The pulse signal is generated based on the calculated duty value.

Hereinafter, a temperature control apparatus and an image forming apparatus according to certain example embodiments will be described with reference to the accompanying drawings.

Figure 1:
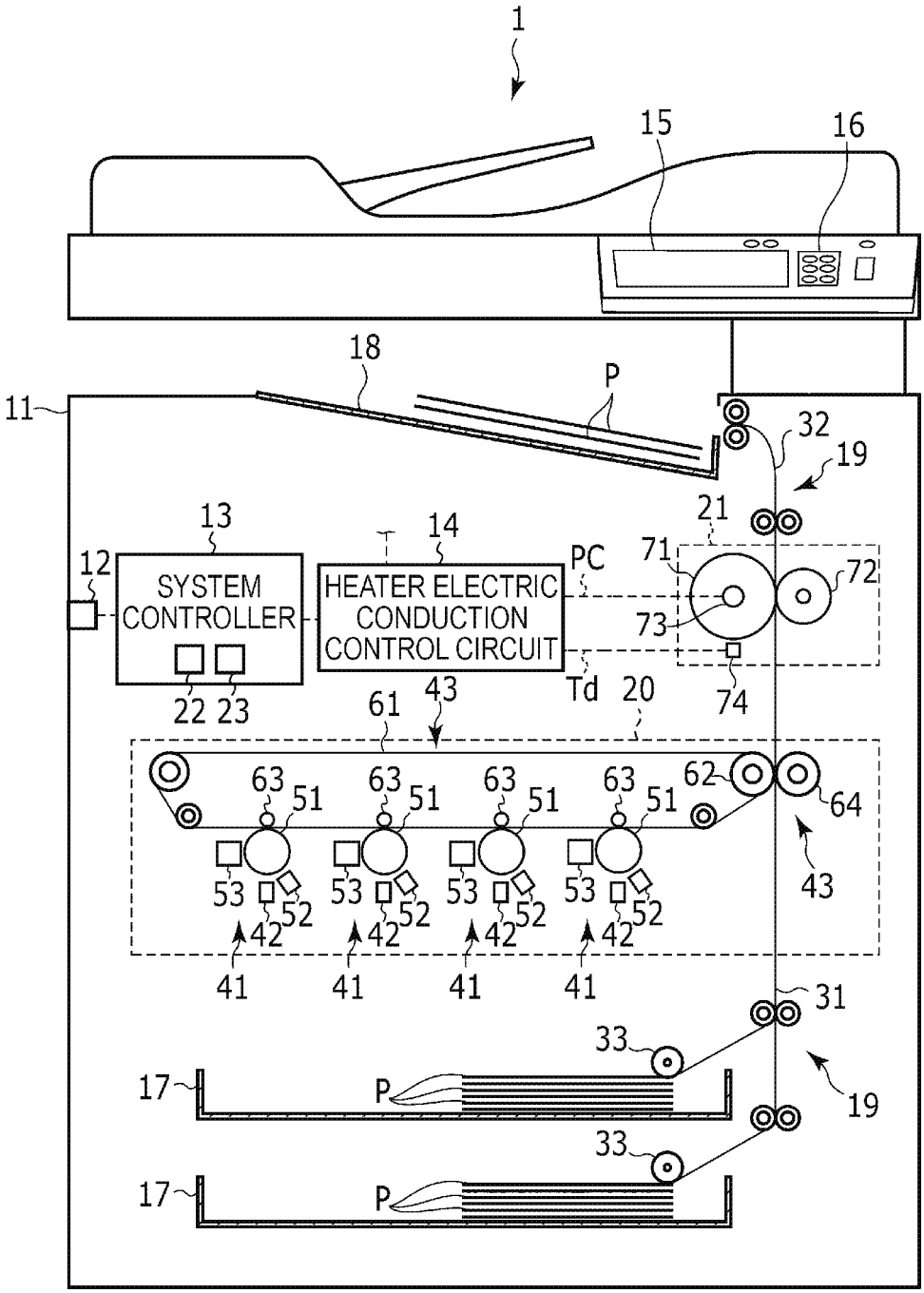
FIG. 1 is a diagram showing an example of a configuration of an image forming apparatus according to an embodiment.

FIG. 1 is a diagram showing a configuration example of an image forming apparatus 1 according to the embodiment.

The image forming apparatus 1 is a multi-function printer (MFP) that performs various processes such as image formation while conveying a recording medium such as a printing medium. The image forming apparatus 1 is a solid scanning type printer (for example, an LED printer) that scans an LED array. The image forming apparatus 1 performs various processes, such as image formation, while conveying a recording medium such as a printing medium (e.g., a sheet of paper or the like).

For example, the image forming apparatus 1 includes a configuration that receives a toner from a toner cartridge and forms an image on the printing medium using the received toner. The toner may be a monochromatic toner, or may be a color toner having a color such as cyan, magenta, yellow, or black. In addition, the toner may be a decolorable toner for performing decoloring if heat is applied.

As shown in FIG. 1, the image forming apparatus 1 includes a housing 11, a communication interface 12, a system controller 13, a heater electric conduction control circuit 14, a display unit 15, an operation interface (e.g., a user input panel), a plurality of sheet trays 17, a sheet discharge tray 18, a conveyance unit 19, an image forming unit 20, and a fixing device 21.

The housing 11 is a main body of the image forming apparatus 1. The housing 11 accommodates the communication interface 12, the system controller 13, the heater electric conduction control circuit 14, the display unit 15, the operation interface, the plurality of sheet trays 17, the sheet discharge tray 18, the conveyance unit 19, the image forming unit 20, and the fixing device 21.

First, a configuration of a control system of the image forming apparatus 1 will be described.

The communication interface 12 is an interface for performing communication with other equipment. The communication interface 12 is used for communication with, for example, a high-order apparatus (external equipment) such as print server or the like. The communication interface 12 is configured as, for example, an LAN connector. In addition, the communication interface 12 may be an interface for performing wireless communication with other equipment in accordance with a standard such as Bluetooth® or The system controller 13 controls overall functioning of the image forming apparatus 1. The system controller 13 includes, for example, a processor 22 and a memory 23.

The processor 22 is an arithmetic element that executes arithmetic processing. The processor 22 is, for example, a central processing unit (CPU). The processor 22 performs various processes on the basis of programs or the like stored in the memory 23. The processor 22 functions as a control unit (controller) capable of executing various operations by executing the programs stored in the memory 23.

The memory 23 is a storage medium that stores programs, data used in the programs, and the like. In addition, the memory 23 also functions as a working memory. That is, the memory 23 temporarily stores data being processed by the processor 22, and programs and the like being executed by the processor 22.

The processor 22 performs various information processing by executing the programs stored in the memory 23. For example, the processor 22 generates a printing job on the basis of an image acquired from external equipment through the communication interface 12. The processor 22 stores the generated printing job in the memory 23.

The printing job includes image data indicating the image to be formed on a printing medium P. The image data may be data for forming an image on one printing medium P, or may be data for forming an image on a plurality of printing media P. Further, the printing job includes information indicating whether or not the printing job is color printing or monochromatic printing. The printing job may include information such as the total number of sheets to be printed and the number of copies of a document to be printed.

In addition, the processor 22 generates printing control information for controlling operations of the conveyance unit 19, the image forming unit 20, and the fixing device 21 on the basis of a generated printing job. The printing control information includes information indicating a timing of paper feeding. The processor 22 supplies the printing control information to the heater electric conduction control circuit 14.

In addition, the processor 22 functions as a controller (engine controller) that controls operations of the conveyance unit 19 and the image forming unit 20 by executing the programs stored in the memory 23. That is, the processor 22 controls conveyance of the printing medium. P by the conveyance unit 19 and control of image formation on the printing medium P by the image forming unit 20.

In some examples, the image forming apparatus 1 may be configured to include an engine controller independently of the system controller 13. In this case, the engine controller controls conveyance of the printing medium P by the conveyance unit 19 and control of image formation on the printing medium P by the image forming unit 20 under the overall control of the system controller 13 that supplies information required for control to the engine controller.

In addition, the image forming apparatus 1 includes a power conversion circuit, not specifically depicted in the drawing. The power conversion circuit supplies a direct current (DC) voltage to various components within the image forming apparatus 1 generated from an AC voltage of an AC power supply. The power conversion circuit supplies the direct current voltage required for the operations of the processor 22 and the memory 23 to the system controller 13. The power conversion circuit supplies a direct current voltage to the image forming unit 20. In addition, the power conversion circuit supplies a direct current voltage to the conveyance unit 19. The power conversion circuit also supplies a direct current voltage for driving a heater of the fixing device 21 to the heater electric conduction control circuit 14.

The heater electric conduction control circuit 14 is a temperature control apparatus (also referred to as a temperature control unit or temperature controller) that controls the electrical power supplied to the heater of the fixing device 21. The heater electric conduction control circuit 14 generates power PC for the heater of the fixing device 21 and supplies the generated power PC to the heater of the fixing device 21.

The display unit 15 includes a display for displaying a screen in response to a video signal which is input from a display control unit such as the system controller 13 or a graphic controller. For example, a screen for performing various settings of the image forming apparatus 1 is displayed on the display of the display unit 15.

The operation interface is connected to an operation panel, a user input device, or the like. The operation interface supplies an operation signal based on the user inputs (e.g., user selections made on a display screen, buttons pressed by a user, or the like) to the system controller 13. A user input device is, for example, a touch sensor, a numeric keypad, a power key, a paper feed key, various function keys, a keyboard, or the like. The touch sensor acquires information indicating a position designated within a certain region of display screen. The touch sensor can be configured integrally with the display unit 15 as a touch panel to permit a user input to generate a signal indicating a touched position on the screen displayed on the display unit 15 to be provided to the system controller 13.

Each of the plurality of sheet trays 17 is a cassette that accommodates printing media P. The sheet tray 17 can be configured such that the printing media P can be supplied from the outside of the housing 11. For example, the sheet tray 17 is configured to be capable of being drawn out from the housing 11.

The sheet discharge tray 18 is a tray that supports the printing medium P discharged from the image forming apparatus 1.

The conveyance unit 19 is a mechanism that conveys the printing medium P within the image forming apparatus 1. As shown in FIG. 1, the conveyance unit 19 includes a plurality of conveyance paths. For example, the conveyance unit 19 includes a sheet supply conveyance path 31 and a sheet discharge conveyance path 32.

The sheet supply conveyance path 31 and the sheet discharge conveyance path 32 comprises a plurality of motors, a plurality of rollers, and a plurality of guides. The plurality of motors rotate a roller under the control of the system controller 13. The plurality of rollers rotate to move the printing medium P along the conveyance paths. The plurality of guides control the conveyance direction of the printing medium P.

The sheet supply conveyance path 31 takes in the printing medium P from the sheet tray 17 and supplies the printing medium P to the image forming unit 20. The sheet supply conveyance path 31 includes pickup rollers 33 corresponding to the respective sheet trays. Each of the pickup rollers 33 takes in the printing medium P of the sheet tray 17 to the sheet supply conveyance path 31.

The sheet discharge conveyance path 32 is a conveyance path that discharges the printing medium P having an image formed thereon from the housing 11. The printing medium. P discharged by the sheet discharge conveyance path 32 is supported by the sheet discharge tray 18.

The image forming unit 20 is configured to form an image on the printing medium P. Specifically, the image forming unit 20 forms an image on the printing medium P on the basis of a printing job generated by the processor 22.

The image forming unit 20 includes a plurality of processing units 41, a plurality of exposure devices 42, and a transfer mechanism 43. The image forming unit 20 includes an exposure device 42 for each processing unit 41. The plurality of processing units 41 and the plurality of exposure devices 42 have the same configuration and thus one processing unit 41 and one exposure device 42 will be described.

The processing unit 41 is configured to form a toner image. For example, the plurality of processing units 41 are provided for each type of toner. For example, the plurality of processing units 41 correspond to color toners such as cyan, magenta, yellow, and black. Specifically, a toner cartridge having toners of different colors is connected to each of the processing units 41.

The toner cartridge includes a toner accommodation container and a toner send-out mechanism. The toner accommodation container is a container that accommodates a toner. The toner send-out mechanism is a mechanism configured by a screw or the like that sends out the toner in the toner accommodation container.

The processing unit 41 includes a photosensitive drum 51, an electrostatic charger 52, and a developing device 53.

The photosensitive drum 51 is a photosensitive body including a cylindrical drum and a photosensitive layer formed on the outer peripheral surface of the drum. The photosensitive drum 51 rotates at a fixed speed by a drive mechanism.

The electrostatic charger 52 uniformly charges the surface of the photosensitive drum 51. For example, the electrostatic charger 52 charges the photosensitive drum 51 to a uniform potential of a negative polarity (contrast potential) by applying a voltage (developing bias voltage) to the photosensitive drum 51 using a charging roller. The charging roller rotates in association with the rotation of the photosensitive drum 51 in a state where predetermined pressure is applied to the photosensitive drum 51.

The developing device 53 is an apparatus that attaches a toner to the photosensitive drum 51. The developing device 53 includes a developer container, a stirring mechanism, a developing roller, a doctor blade, an auto toner control (ATC) sensor, and the like.

The developer container receives a toner sent out from the toner cartridge and accommodates the toner therein. Carriers are typically accommodated in the developer container in advance of a printing operation. The toner sent out from the toner cartridge is stirred with carriers by the stirring mechanism to form a developer in which the toner and the carriers are mixed with each other. The carriers are typically accommodated in the developer container when the developing device 53 is manufactured.

The developing roller rotates within the developer container to attach a developer to the surface of the developing roller. The doctor blade is a member disposed at a predetermined interval from the surface of the developing roller. The doctor blade removes a portion of the developer attached to the surface of the rotating developing roller. Thereby, a developer layer having a thickness corresponding to the interval between the doctor blade and the surface of the developing roller is formed on the surface of the developing roller.

The ATC sensor is a magnetic flux sensor that includes, for example, a coil and detects the value of a voltage generated in the coil. The detected voltage of the ATC sensor changes depending on the density of a magnetic flux from a toner within the developer container. That is, the system controller 13 determines a concentration ratio (toner concentration ratio) of a toner remaining to carriers in the developer container on the basis of the detected voltage of the ATC sensor. The system controller 13 operates a motor which drives the send-out mechanism of the toner cartridge on the basis of the toner concentration ratio, and sends out a toner to the developer container of the developing device 53 from the toner cartridge.

The exposure device 42 includes a plurality of light emitting elements. The exposure device 42 forms a latent image on the photosensitive drum 51 by irradiating the charged photosensitive drum 51 with light from the light emitting element. The light emitting element is, for example, a light emitting diode (LED) or the like. One light emitting element is configured to irradiate one point on the photosensitive drum 51 with light. The plurality of light emitting elements are arranged in a main scanning direction (which is a direction parallel to a rotation axis of the photosensitive drum 51).

The exposure device 42 forms a latent image for one line on the photosensitive drum 51 by irradiating the photosensitive drum 51 with light by the plurality of light emitting elements arranged in a main scanning direction. The exposure device 42 eventually forms a latent image comprised of a plurality of lines by irradiating the rotating photosensitive drum 51 line by line with light.

In the above-described example, an electrostatic latent image is formed by irradiating the surface of the photosensitive drum 51 that was previously charged by the electrostatic charger 52. The surface of the photosensitive drum 51 is irradiated with light from the exposure device 42. When the developer layer formed on the surface of the developing roller approaches the surface of the photosensitive drum 51, a toner contained in the developer becomes attached to the still charged portions of the latent image formed on the surface of the photosensitive drum 51. Thereby, a toner image is formed on the surface of the photosensitive drum 51 in correspondence with the latent image.

The transfer mechanism 43 is configured to transfer the toner image on the surface of the photosensitive drum 51 to the printing medium P.

The transfer mechanism 43 includes, for example, a primary transfer belt 61, a secondary transfer counter roller 62, a plurality of primary transfer rollers 63, and a secondary transfer roller 64.

The primary transfer belt 61 is an endless belt wound around the secondary transfer counter roller 62 and a plurality of winding rollers. The primary transfer belt 61 is configured such that an inner surface (inner peripheral surface) comes into contact with the secondary transfer counter roller 62 and the plurality of winding rollers, and an outer surface (outer peripheral surface) is opposite to the photosensitive drum 51 of the processing unit 41.

The secondary transfer counter roller 62 is rotated by a motor. The secondary transfer counter roller 62 rotates to convey the primary transfer belt 61 in a predetermined conveyance direction. The plurality of winding rollers are configured to be freely rotatable. The plurality of winding rollers are rotated in association with the movement of the primary transfer belt 61 by the secondary transfer counter roller 62.

The primary transfer rollers 63 are configured to bring the primary transfer belt 61 into contact with the photosensitive drum 51 of the processing unit 41. The primary transfer rollers 63 are provided to correspond to each of the photosensitive drums 51 of the plurality of processing units 41. Specifically, a primary transfer rollers 63 is provided at a position facing the photosensitive drum 51 of the corresponding processing unit 41 with the primary transfer belt 61 interposed therebetween. The primary transfer roller 63 comes into contact with the inner peripheral surface side of the primary transfer belt 61 and displaces the primary transfer belt 61 to the photosensitive drum 51 side. Thereby, the primary transfer roller 63 brings the outer peripheral surface of the primary transfer belt 61 into contact with the photosensitive drum 51.

The secondary transfer roller 64 is provided at a position facing the primary transfer belt 61. The secondary transfer roller 64 comes into contact with the outer peripheral surface of the primary transfer belt 61 and applies pressure. Thereby, a transfer nip at which the secondary transfer roller 64 and the outer peripheral surface of the primary transfer belt 61 are in close contact with each other is formed. When the printing medium P passes through the transfer nip, the secondary transfer roller 64 presses the printing medium P passing through the transfer nip against the outer peripheral surface of the primary transfer belt 61.

The secondary transfer roller 64 and the secondary transfer counter roller 62 rotate to convey the printing medium P therebetween. Thereby, the printing medium P passes through the transfer nip.

In the above-described example, when the outer peripheral surface of the primary transfer belt 61 comes into contact with the photosensitive drum 51, a toner image formed on the surface of the photosensitive drum is transferred to the outer peripheral surface of the primary transfer belt 61. If the image forming unit 20 includes the plurality of processing units 41, the primary transfer belt 61 receives a toner image from the photosensitive drums 51 of each of the plurality of processing units 41. The different toner images transferred to the outer peripheral surface of the primary transfer belt 61 are conveyed to the transfer nip by rotation of the primary transfer belt 61. If the printing medium P is present at the transfer nip, the toner images transferred to the outer peripheral surface of the primary transfer belt 61 are transferred to the printing medium P in the transfer nip.

The fixing device 21 fixes a toner image to the printing medium P. The fixing device 21 operates under the control of the system controller 13 and the heater electric conduction control circuit 14. The fixing device 21 includes a fixing rotating body, a pressing member, and a heating member. The fixing rotating body is, for example, a heat roller 71. In addition, the pressing member is, for example, a pressing roller 72. The heating member is, for example, a heater 73 that heats the heat roller 71. Further, the fixing device 21 includes a temperature sensor 74 (thermal sensor) that detects the temperature of the surface of the heat roller 71.

The heat roller 71 rotates by a motor. The heat roller 71 comprises a core metal member formed of a hollow metal tube (or cylinder) and an elastic layer formed on the outer periphery of the core metal member. The heat roller 71 is configured such that the inner side of the core metal member is heated by the heater 73 disposed on the inner side of the core metal member, which is formed to have a hollow shape (open interior region). Heat generated on the inner side of the core metal member is transmitted to the surface of the heat roller 71 (that is, the surface of the elastic layer) which is on the outside of the core metal member.

The pressing roller 72 is provided at a position facing the heat roller 71. The pressing roller 72 includes a core metal member having a predetermined outer diameter and an elastic layer formed on the outer periphery of the core metal member. The pressing roller 72 applies pressure to the heat roller 71 due to a force applied from a tension member or spring member. Pressure is applied to the heat roller 71 from the pressing roller 72, so that a nip (a fixing nip) at which the pressing roller 72 and the heat roller 71 are in close contact with each other is formed. The pressing roller 72 is rotated by a motor. The pressing roller 72 rotates to move the printing medium P having entered the fixing nip and press the printing medium P against the heat roller 71.

The heater 73 is an apparatus that generates heat using the power PC supplied from the heater electric conduction control circuit 14. The heater 73 is, for example, a halogen heater. The heater 73 generates heat on the inner side of the core metal member of the heat roller 71 with light from a halogen lamp heater supplied with the power PC from the heater electric conduction control circuit 14. In addition, the heater 73 is, for example, an induction-type heater or the like.

The temperature sensor 74 detects the temperature of air in the vicinity of the surface of the heat roller 71 (the surrounding temperature). The number of temperature sensors 74 may be two or more. For example, the plurality of temperature sensors 74 may be arranged in parallel with the rotation axis of the heat roller 71. The temperature sensor 74 may be provided at any position where a change in the temperature of the heat roller can be detected. The temperature sensor 74 supplies a temperature detection signal Td indicating a detection result to the heater electric conduction control circuit 14.

With the above-described configuration, the heat roller 71 and the pressing roller 72 apply heat and pressure to the printing medium P passing through the fixing nip. A toner on the printing medium P is melted by heat applied from the heat roller 71, and is applied to the surface of the print medium P due to pressure applied by the heat roller 71 and the pressing roller 72. Thereby, a toner image is fixed to the printing medium P having passed through the fixing nip. The printing medium P having passed through the fixing nip is next introduced into the sheet discharge conveyance path 32 and is discharged to the outside of the housing 11.

The heater electric conduction control circuit 14 controls electrical conduction of the fixing device 21 to the heater 73. The heater electric conduction control circuit 14 generates power PC for the heater 73 of the fixing device 21 and supplies the generated power PC to the heater 73 of the fixing device 21.

Figure 2:
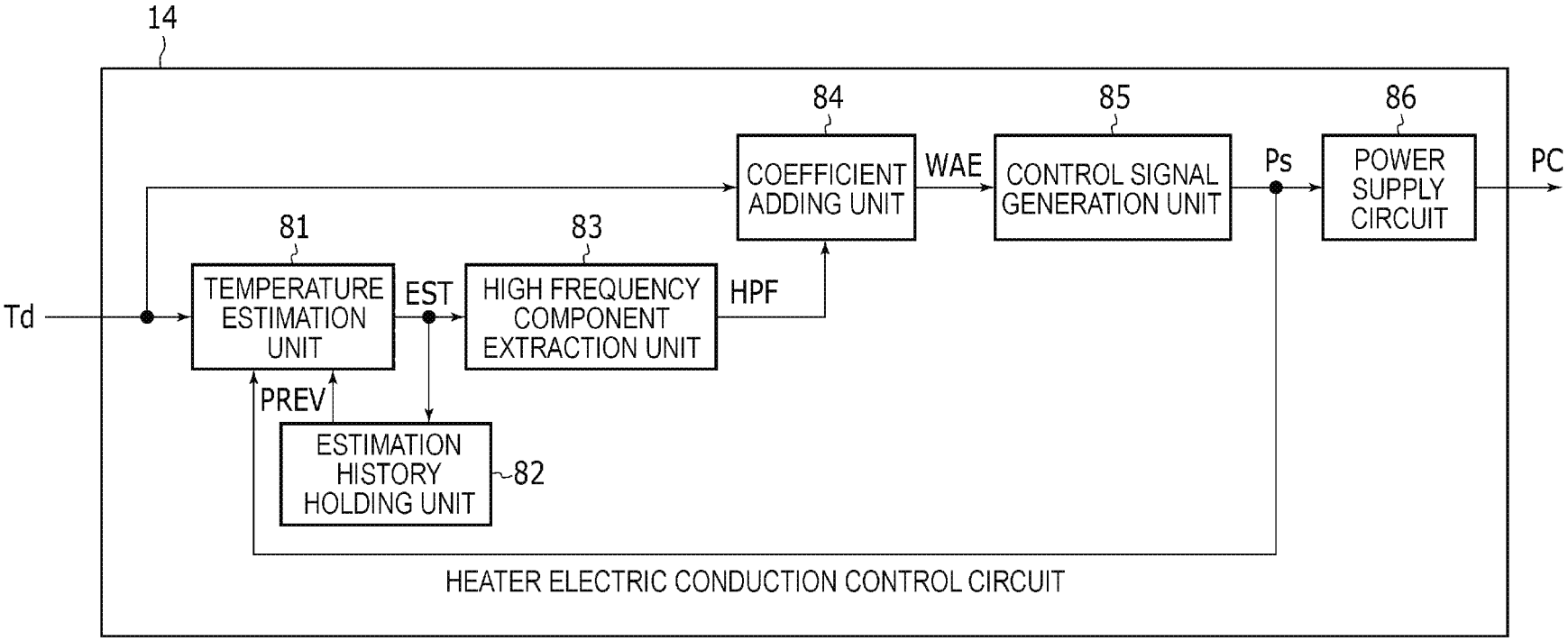
FIG. 2 is a diagram showing an example of a configuration of a heater electric conduction control circuit.

As shown in FIG. 2, the heater electric conduction control circuit 14 includes a temperature estimation unit 81, an estimation history holding unit 82, a high frequency component extraction unit 83, a coefficient adding unit 84, a control signal generation unit 85, and a power supply circuit 86. In addition, the temperature detection result Td is input to the heater electric conduction control circuit 14 from the temperature sensor 74.

The temperature estimation unit 81 performs temperature estimation processing for estimating the temperature of the surface of the heat roller 71. The temperature detection result Td obtained from the temperature sensor 74, an estimation history PREV obtained from the estimation history holding unit 82, and a pulse Ps obtained from the control signal generation unit 85 are input to the temperature estimation unit 81. The temperature estimation unit 81 generates a temperature estimation result EST on the basis of the temperature detection result Td, the estimation history PREV, and the pulse Ps. In addition, the temperature estimation unit 81 may be configured to generate the temperature estimation result EST on the basis of the temperature detection result Td, the estimation history PREV, the pulse Ps, and a voltage (rated voltage) supplied to the heater 73 if the pulse Ps when the value of the pulse Ps indicates an on-state for the heater 73. The temperature estimation unit 81 outputs the temperature estimation result EST to the estimation history holding unit 82 and the high frequency component extraction unit 83.

The estimation history holding unit 82 holds a history of the temperature estimation result EST. The estimation history holding unit 82 outputs the estimation history PREV which is a history of the temperature estimation result EST (the past temperature estimation result EST) to the temperature estimation unit 81.

The high frequency component extraction unit 83 performs a high-pass filter processing for extracting the high frequency component of the temperature estimation result EST. The high frequency component extraction unit 83 outputs a high frequency component HPF, which is a signal corresponding to the extracted high frequency component, to the coefficient adding unit 84.

The coefficient adding unit 84 performs a coefficient adding processing, which is correction of the temperature detection result Td. The temperature detection result Td (obtained from the temperature sensor 74) and the high frequency component HPF (obtained from the high frequency component extraction unit 83) are both input to the coefficient adding unit 84. The coefficient adding unit 84 corrects the temperature detection result Td on the basis of the high frequency component HPF. Specifically, the coefficient adding unit 84 multiplies the high frequency component HPF by a preset coefficient and adds the result of the multiplication to the temperature detection result Td to calculate a corrected temperature value WAE.

The high frequency component HPF (from the high frequency component extraction unit 83) is based on the temperature estimation result EST (from the temperature estimation unit 81), and thus it can be said that the corrected temperature value WAE is also based on the temperature estimation result EST along with the temperature detection result Td. The coefficient adding unit 84 outputs the corrected temperature value WAE to the control signal generation unit 85.

The control signal generation unit 85 generates pulse Ps which is a pulse signal for controlling power supplied to the heater 73 on the basis of the corrected temperature value WAE obtained from the coefficient adding unit 84. The control signal generation unit 85 outputs the pulse Ps to the power supply circuit 86 and the temperature estimation unit 81.

The power supply circuit 86 supplies the power PC to the heater 73 on the basis of the pulse Ps (pulse signal). The power supply circuit 86 performs electrical conduction to the heater 73 of the fixing device 21 using a direct current voltage supplied from a power conversion circuit. The power supply circuit 86 supplies the power PC to the heater 73 by turning on and off a direct current voltage supplied from the power conversion circuit to the heater 73 on the basis of the value of pulse Ps. That is, the power supply circuit 86 can change when, and for how long, power is supplied to the heater 73 of the fixing device 21 in accordance with the changing values (e.g., high/low signal values) of pulse Ps.

The power supply circuit 86 may be configured integrally with the fixing device 21. That is, the heater electric conduction control circuit 14 may be configured to supply the pulse Ps to the power supply circuit of the heater 73 of the fixing device 21 instead of directly supplying the power PC to the heater 73.

As described above, the heater electric conduction control circuit 14 adjusts the amount of power supplied to the heater 73 of the fixing device 21 on the basis of a temperature detection result Td, an estimation history PREV of a temperature, and an electrical pulse Ps ("pulse Ps" or "pulse signal Ps"). Thereby, the heater electric conduction control circuit 14 controls the surface temperature of the heat roller 71 heated by the heater 73. Such control will be referred to as weighted average control with estimated temperature ("WAE" control). Each of the temperature estimation unit 81, the estimation history holding unit 82, the high frequency component extraction unit 83, the coefficient adding unit 84, and the control signal generation unit 85 of the heater electric conduction control circuit 14 may be an electric circuit or may be implemented in software.

WAE control will be described in more detail.

Figure 3:
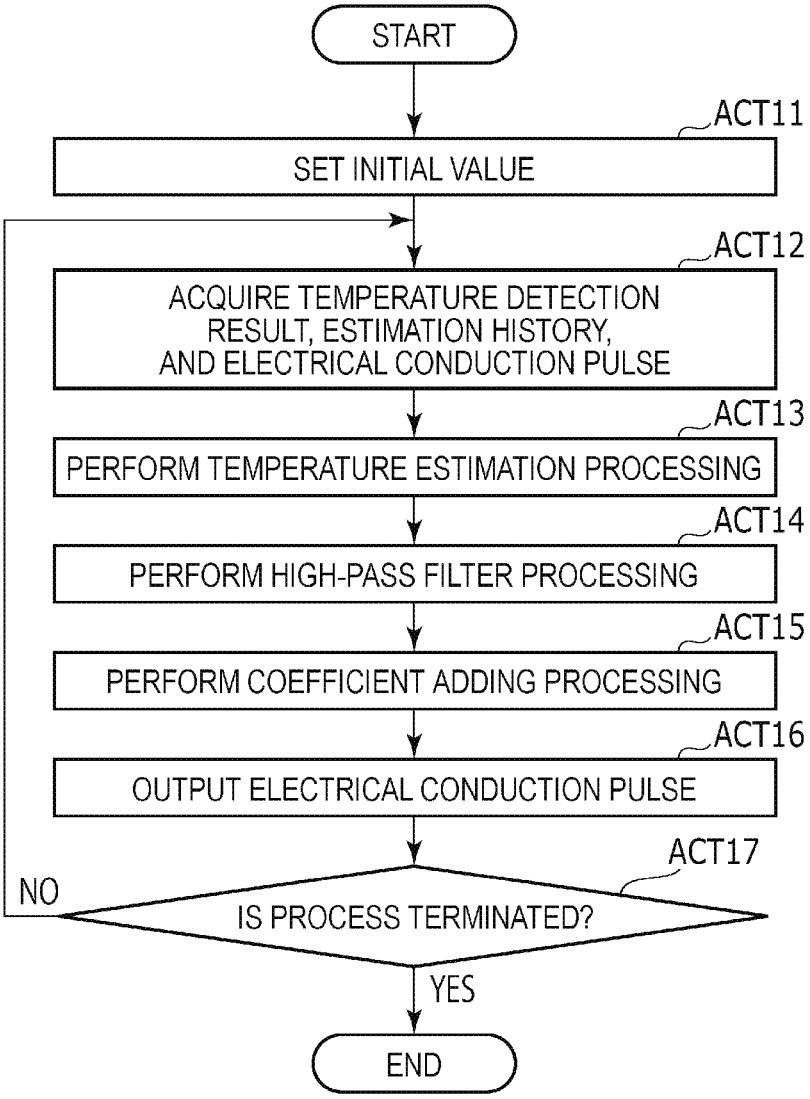
FIG. 3 is a diagram showing an example of an operation of the heater electric conduction control circuit.
Figure 4:
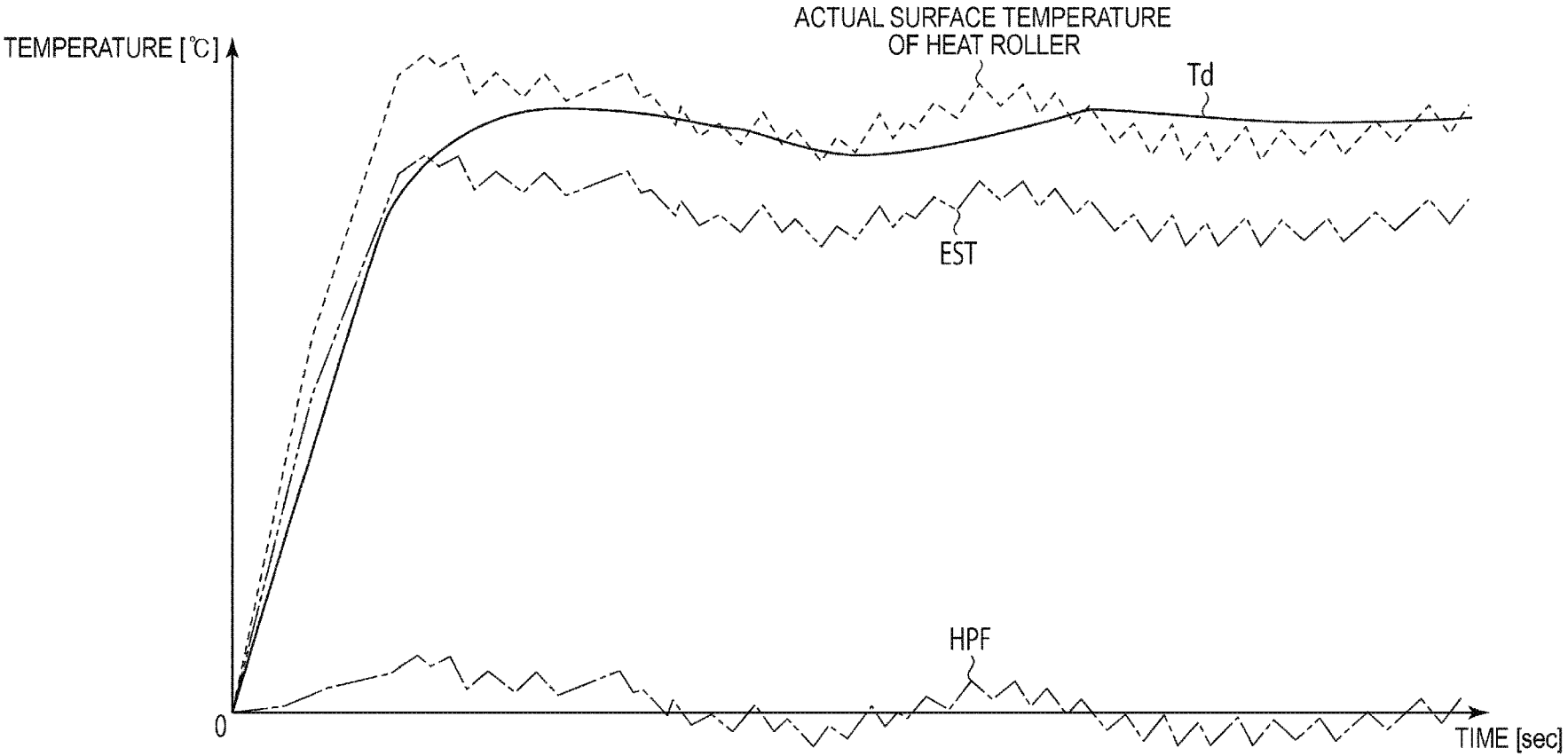
FIG. 4 is a diagram showing an example of an operation of the heater electric conduction control circuit.
Figure 5:
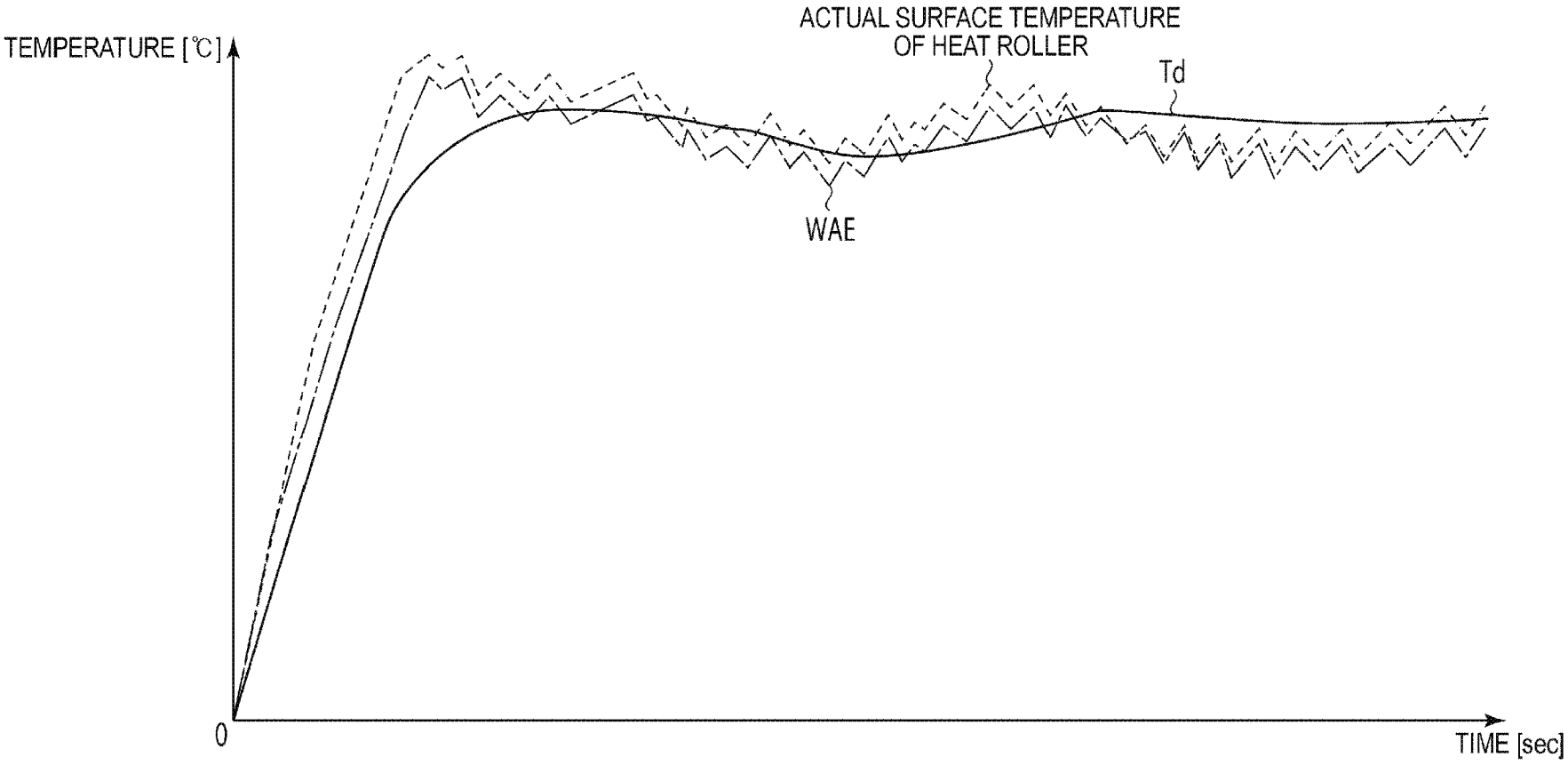
FIG. 5 is a diagram showing an example of an operation of the heater electric conduction control circuit.

FIG. 3 is a flowchart showing aspects of WAE control. FIGS. 4 and 5 are diagrams showing signals and the like in WAE control. The horizontal axes in FIGS. 4 and 5 represent a time. The vertical axes in FIGS. 4 and 5 represent a temperature.

The heater electric conduction control circuit 14 performs setting of various initial values (ACT 11). For example, the heater electric conduction control circuit 14 sets a coefficient in the coefficient adding unit 84, and the like on the basis of a signal received from the system controller 13.

The temperature estimation unit 81 of the heater electric conduction control circuit 14 acquires a temperature detection result Td from the temperature sensor 74, an estimation history PREV from the estimation history holding unit 82, and a pulse Ps from the control signal generation unit 87 (ACT 12).

As shown in FIG. 4, there is generally a difference between the temperature detection result Td and the actual surface temperature of the heat roller 71. Since the surface temperature of the heat roller 71 is being intermittently heated by the heater 73, the surface temperature changes on a relatively fine cycle in response to the intermittent operation of the heater 73. On the other hand, the temperature sensor 74 may have poor responsiveness (response lag) to changes in temperature due to its own heat capacity and the characteristics of a temperature-sensitive material used in the temperature sensor 74. In particular, cheaper temperature sensors tend to have poorer responsiveness. As a result, the temperature detection result Td cannot immediately follow the actual surface temperature of the heat roller 71. That is, the temperature detection result Td as detected by the temperature sensor 74 is delayed with respect to actual changes in the surface temperature of the heat roller 71. In addition, the temperature detection result Td as detected by the temperature sensor 74 lacks the fine resolution necessary to precisely track each change in the surface temperature of the heat roller 71 so the temperature detection result Td is smoothed as compared to the actual changes in surface temperature.

The temperature estimation unit 81 performs temperature estimation processing (ACT 13). That is, the temperature estimation unit 81 generates a temperature estimation result EST on the basis of the temperature detection result Td, the estimation history PREV, and the pulse Ps. The temperature estimation unit 81 outputs the temperature estimation result EST to the high frequency component extraction unit 83 and the estimation history holding unit 82.

Heat transfer can be expressed equivalently with a RC time constant of the electric circuit. Heat capacity is replaced by a capacitor C. Heat transfer resistance is replaced by resistance R. A heat source is replaced by a direct current voltage source. The temperature estimation unit 81 estimates the amount of heat applied to the heat roller 71 on the basis of a RC circuit in which the value of each element is set in advance, on the basis of the amount of electrical conduction to the heater 73, heat capacity of the heat roller 71, and the like. The temperature estimation unit 81 estimates the surface temperature of the heat roller 71 on the basis of the amount of heat applied to the heat roller 71, the temperature detection result Td, and the estimation history PREV, and outputs the temperature estimation result EST.

Regarding the temperature estimation unit 81, electrical conduction and cut-off from the direct current voltage source are repeated on the basis of the pulse Ps, the RC circuit is operated in accordance with an input voltage pulse, and an output voltage is generated. Thereby, it is possible to estimate heat propagated through the surface of the heat roller 71 to be controlled.

Heat from the heat roller 71 flows out to an external environment through a space within the fixing device 21 (to the outside of the heat roller 71). For this reason, the temperature estimation unit 81 further includes a RC circuit for estimating the flow-out of heat to the external environment from the heat roller 71. In addition, the temperature estimation unit 81 may further include a RC circuit for estimating the amount of heat flowing into a space within the fixing device 21 from the heat roller 71.

As shown in FIG. 4, the temperature estimation result EST appropriately follows a change in the actual surface temperature of the heat roller 71. However, the temperature estimation result EST is a simulation result, and thus there is a possibility that an absolute value will be different from the actual surface temperature of the heat roller due to a difference in a condition, or the like.

The high frequency component extraction unit 83 performs high-pass filter processing for extracting a high frequency component of the temperature estimation result EST (ACT 14). As shown in FIG. 4, a high frequency component HPF which is a signal corresponding to the high frequency component of the temperature estimation result EST appropriately follows a change in the actual surface temperature of the heat roller 71.

The coefficient adding unit 84 performs a coefficient adding processing, which is the correction of the temperature detection result Td (ACT 15). The coefficient adding unit 84 multiplies the high frequency component HPF (obtained from the high frequency component extraction unit 83) by a preset coefficient and then adds the high frequency component HPF (after it has been multiplied by the coefficient) to the temperature detection result Td to calculate a corrected temperature value WAE. That is, the coefficient adding unit 84 adjusts the value of the high frequency component HPF (from the high frequency component extraction unit 83) by multiply by the coefficient before the adjusted high frequency component HPF value is added to the temperature detection result Td for providing the corrected temperature value WAE.

For example, if the coefficient is 1, the coefficient adding unit 84 directly adds the high frequency component HPF (obtained from the high frequency component extraction unit 83) to the temperature detection result Td. If the coefficient is 0.1, the coefficient adding unit 84 adds the value of one-tenth of the high frequency component HPF (obtained from the high frequency component extraction unit 83) to the temperature detection result Td. In this case, the effect of the high frequency component HPF is almost eliminated, and the temperature detection result Td is approximated. In addition, for example, if the coefficient is 1 or greater, the effect of the high frequency component HPF can be expressed more strongly. A result obtained through experiment shows that the value of a coefficient set by the coefficient adding unit 84 is not a very extreme value and is preferably approximately 1.

FIG. 5 is a diagram showing examples of the actual surface temperature of the heat roller 71, the temperature detection result Td, and the corrected temperature value WAE. In WAE control, fine changes in the surface temperature of the heat roller 71 are estimated on the basis of the temperature detection result Td and the high frequency component HPF of the temperature estimation result EST. For this reason, as shown in FIG. 5, the corrected temperature value WAE is a value better following the changes in the surface temperature of the heat roller 71.

The control signal generation unit 85 generates pulse Ps on the basis of the corrected temperature value WAE received from the coefficient adding unit 84. The control signal generation unit 85 outputs the pulse Ps to the power supply circuit 86 and the temperature estimation unit 81 (ACT 16). The power supply circuit 86 supplies electrical power PC ("power PC") to the heater 73 on the basis of the pulse Ps.

The processor 22 of the system controller 13 determines whether or not to terminate the WAE control (ACT 17). If the processor 22 determines to continue the WAE control, the processor proceeds to the process of ACT 12. In addition, if the processor determines to terminate the WAE control, the processor terminates the processing of FIG. 3.

As described above, if the heater electric conduction control circuit 14 performs processing at a certain cycle (the cycle), the heater electric conduction control circuit 14 performs WAE control on the basis of values one cycle prior (more particularly, the pulse Ps value for the prior cycle and the temperature estimation result EST from the prior cycle, which is also referred to as an estimation history PREV) and a temperature detection result Ts in the present cycle. That is, the heater electric conduction control circuit 14 adjusts a value for the next cycle. The heater electric conduction control circuit 14 performs temperature estimation calculation again on the basis of the history of the previous calculation. Thus, the heater electric conduction control circuit 14 performs calculation during operations at all times. In the heater electric conduction control circuit 14, calculation results are held in a memory or the like and used again in the calculation for the next cycle.

Figure 6:
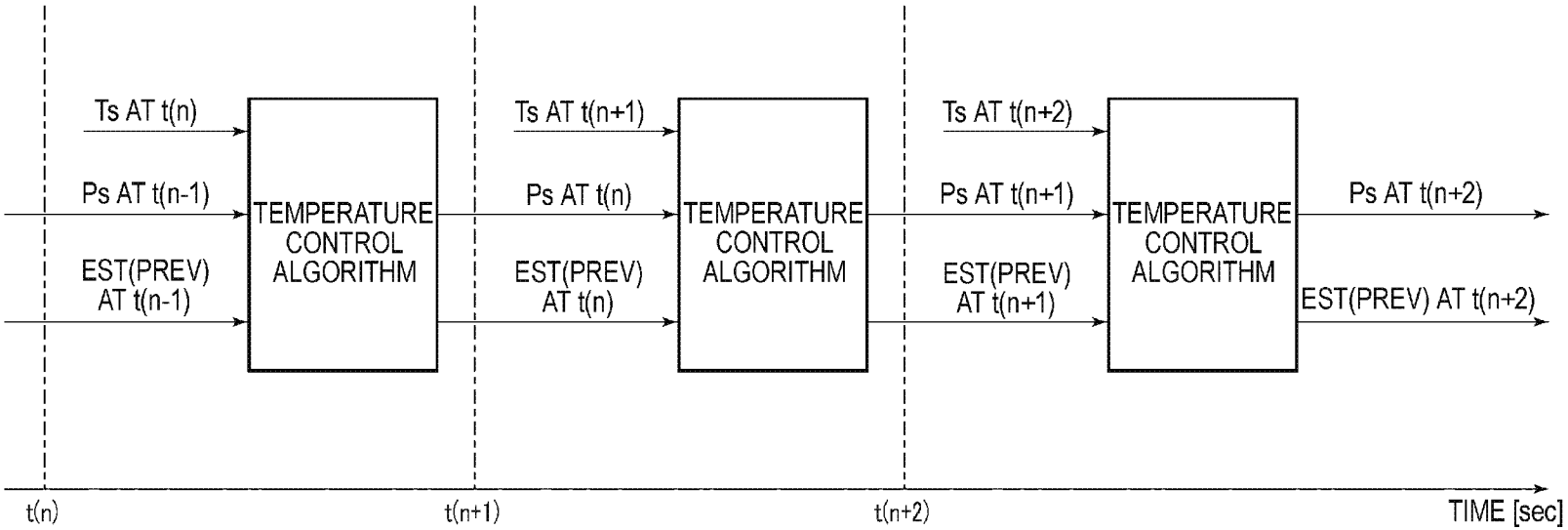
FIG. 6 is a diagram showing an example of an operation of the heater electric conduction control circuit.

FIG. 6 is a diagram showing a cycle of processing in the heater electric conduction control circuit 14. The horizontal axis in FIG. 6 represents a time. For example, the temperature estimation unit 81 performs temperature estimation processing at time t(n), performs the next temperature estimation processing at time t(n+1) (the time after the time interval dt has elapsed after time t(n)), and performs temperature estimation processing at time t(n+2) (the time after time interval dt has elapsed after time t (n+1)). In this manner, the temperature estimation unit 81 performs temperature estimation processing repeatedly. The temperature estimation unit 81 uses the previous temperature estimation result EST in the estimation of a new temperature in temperature estimation processing of each cycle.

At time t (n), a temperature detection result Td at time t (n), the pulse Ps value at the previous time t(n−1), and a temperature estimation result EST for the previous time t(n−1) (estimation history PREV) are input to the temperature estimation unit 81. The temperature estimation unit 81 performs processing and outputs the temperature estimation result EST for time t(n). The high frequency component extraction unit 83, the coefficient adding unit 84, and the control signal generation unit 85 perform processing and output the pulse Ps for time t(n).

At time t(n+1), a temperature detection result Td which is newly detected at time t(n+1), the pulse Ps at time t(n), and an estimation history PREV (which is a temperature estimation result EST for time t(n)) are input to the temperature estimation unit 81. The temperature estimation unit 81 performs processing and outputs the temperature estimation result EST for time t(n+1). The high frequency component extraction unit 83, the coefficient adding unit 84, and the control signal generation unit 85 perform processing and output the pulse Ps for time t(n+1).

At time t(n+2), a temperature detection result Td which is newly detected at time t(n+2), the pulse Ps at time t(n+1), and an estimation history PREV (which is a temperature estimation result EST at time t (n+1)) are input to the temperature estimation unit 81. The temperature estimation unit 81 performs processing and outputs the temperature estimation result EST for time t (n+2). The high frequency component extraction unit 83, the coefficient adding unit 84, and the control signal generation unit 85 perform processing and output the pulse Ps for time t(n+2).

The time interval dt may be a fixed value or may be set based on an initial value set in ACT 11. For example, the time interval dt is set to 100 msec.

Figure 7:
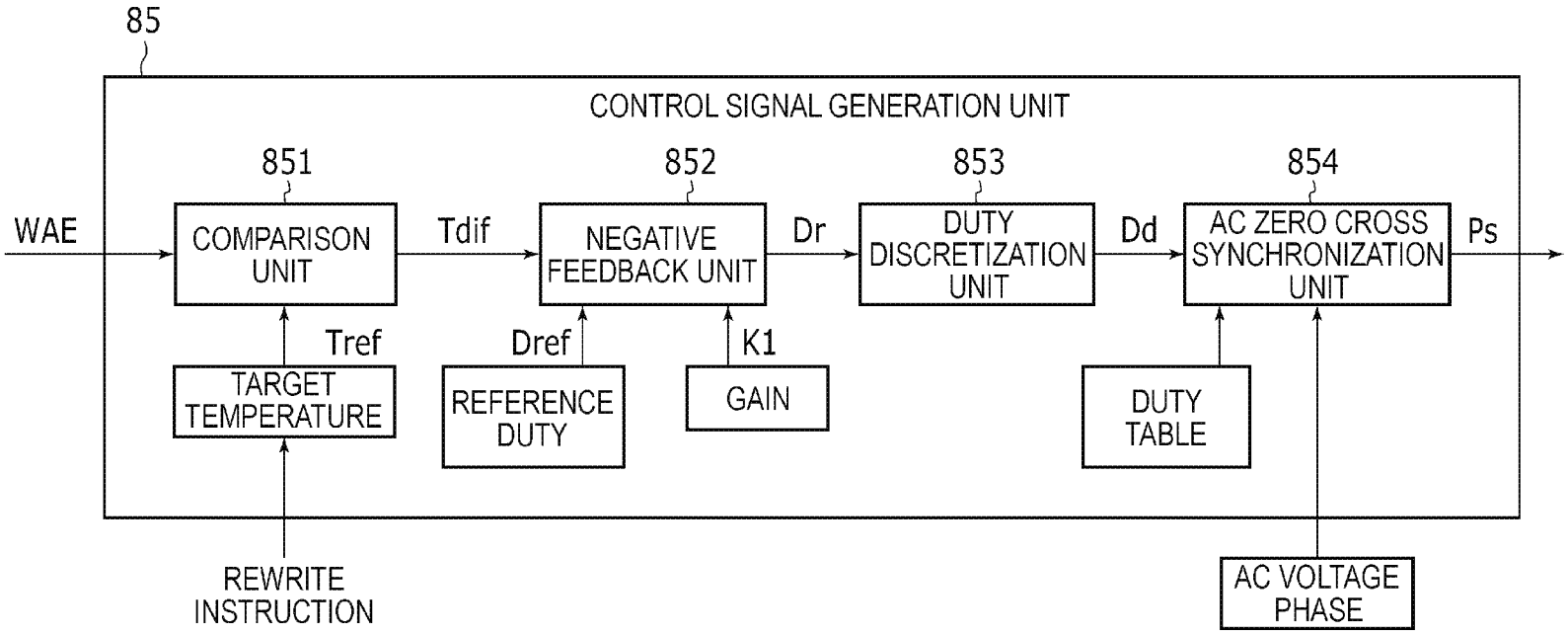
FIG. 7 is a diagram showing an example of a configuration of a control signal generation unit.

FIG. 7 is a block diagram showing a configuration example of the control signal generation unit 85.

The control signal generation unit 85 generates pulse Ps (which is a pulse signal for controlling power supplied to the heater 73) on the basis of a corrected temperature value WAE received from the coefficient adding unit 84. In a typical example, the control signal generation unit 85 calculates a duty value Dr on the basis of the corrected temperature value WAE and the target temperature Tref and outputs the pulse Ps according to the calculated the duty value Dr. Setting the pulse Ps based on the corrected temperature value WAE and the target temperature Tref corresponds to setting the pulse Ps based on a temperature estimation result EST, a temperature detection result Td, and a target temperature Tref.

The control signal generation unit 85 includes a comparison unit 851, a negative feedback unit 852, a duty discretization unit 853, and an AC zero cross synchronization unit 854.

The comparison unit 851 performs difference calculation processing for calculating the difference Tdif between the target temperature Tref and the corrected temperature value WAE received from the coefficient adding unit 84. The comparison unit 851 outputs the difference Tdif to the negative feedback unit 852.

The target temperature Tref is a target value for the surface temperature of the heat roller 71. The target temperature Tref can be changed (rewritten) in response to an instruction from the processor 22 (system controller 13). The target temperature Tref may be stored in the memory 23 or may be stored in the control signal generation unit 85. For example, the target temperature Tref is changed by the processor 22 according to print settings for a printing process.

In one example, the target temperature Tref setting varies depending on the quality of a printing medium P (e.g., paper thickness or the like) being used in a printing process. In this example, if the printing medium P is thicker than a reference medium, the target temperature Tref may be increased. If the printing medium P is thinner than a reference medium, the target temperature Tref may be decreased.

In another example, the target temperature Tref is varied according to the present status or state of a printing process.

Here, description is given on the assumption that the difference Tdif is a value obtained by subtracting the corrected temperature value WAE from the target temperature Tref, but vice versa can also be adopted. If the corrected temperature value WAE is lower than the target temperature Tref, the difference Tdif is a positive value. If the correction temperature value WAE is higher than the target temperature Tref, the difference Tdif is a negative value. A relationship between the target temperature Tref and the correction temperature value WAE is included in the difference Tdif.

The negative feedback unit 852 performs duty value calculation processing for calculating a duty value Dr on the basis of the difference Tdif obtained from the comparison unit 851. The duty value corresponds to a duty ratio. The duty value Dr is a value that varies according to the difference Tdif. The negative feedback unit 852 corresponds to a calculation unit that calculates the duty value Dr. The duty value Dr is a real number. The negative feedback unit 852 outputs the duty value Dr to the duty discretization unit 853.

For example, the negative feedback unit 852 calculates the duty value Dr on the basis of the difference Tdif, a reference duty value Dref, and a gain K1. The reference duty value Dref is determined in advance. The gain K1 is a coefficient for correcting the reference duty value Dref in accordance with the difference Tdif. The reference duty value Dref and gain K1 may be stored in the memory 23 or may be stored in the control signal generation unit 85.

The duty discretization unit 853 performs discretization processing for discretizing the duty value Dr obtained from the negative feedback unit 852. The discretization refers to conversion into a duty value based on a resolution of control. Here, a 5% resolution is described as an example, but a resolution is not limited thereto. The duty discretization unit 853 generates a duty value Dd on the basis of discretization of the duty value Dr. The duty value Dd is a value obtained by converting the duty value Dr in accordance with a resolution. The duty value Dd may also be a second duty value.

The AC zero cross synchronization unit 854 generates a pulse Ps on the basis of the duty value Dd obtained from the duty discretization unit 853. In a typical example, the AC zero cross synchronization unit 854 selects a duty pattern from a duty table on the basis of the duty value Dd. The AC zero cross synchronization unit 854 generates the pulse Ps in accordance with the selected duty pattern. The AC zero cross synchronization unit 854 is a generation unit that generates the pulse Ps. The duty table may be stored in the memory 23 or may be stored in the control signal generation unit 85.

The AC zero cross synchronization unit 854 outputs the generated pulse Ps. The AC zero cross synchronization unit 854 acquires an AC voltage phase and synchronizes output processing for the outputting of the pulse Ps to the AC voltage on the basis of the AC voltage phase. In a typical example, the AC zero cross synchronization unit 854 outputs the pulse Ps in synchronization with a zero cross of the AC voltage (zero voltage point in the AC cycle). The AC zero cross synchronization unit 854 corresponds to an output unit that outputs the pulse Ps.

Figure 8:
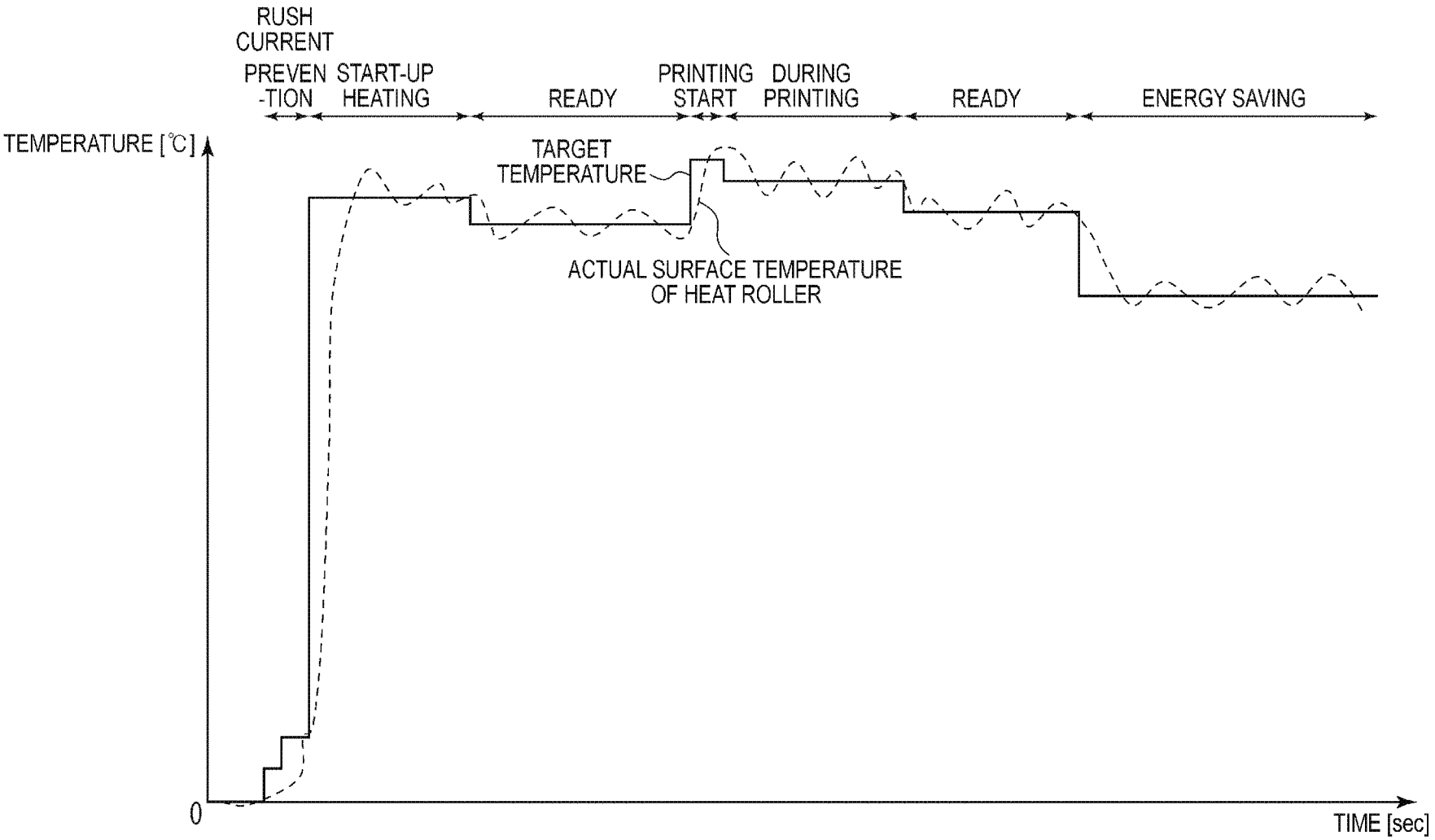
FIG. 8 is a diagram showing an example of a target temperature setting.

A target temperature Tref depending on the status of a printing process will be described. FIG. 8 is a diagram showing an example of a target temperature Tref depending on the status of a printing process.

The horizontal axis in FIG. 8 represents time. The vertical axis in FIG. 8 represents temperature. A solid line indicates a target temperature Tref. A dashed line indicates the actual surface temperature of the heat roller 71.

The printing process includes various stages, modes, or states. For example, the stages/states of the printing process includes rush current prevention, start-up heating, ready state, printing start, printing mode, energy saving mode, and the like, but is not limited thereto.

During the rush current prevention stage, the target temperature is set to rise in a stepwise manner so that a large current does not flow suddenly. During start-up heating stage, the target temperature is set to be high so as to rapidly reach a reference temperature that is suitable for printing processes. At the ready stage, the target temperature is set to be slightly lower than the target temperature used in the start-up heating in order to save energy after the printer becomes ready for use. At the printing start stage, the target temperature is set to be higher than a target temperature used during printing so that the temperature does not fall at the beginning of printing. During the printing stage, the target temperature is set to be a reference temperature suitable for printing. In the energy saving state, if a ready state (or an approximately ready state) is to be maintained for a long period of time, the target temperature is set to be lower than the target temperature used during the ready stage.

Target temperatures Tref in the respective stages/states can be different from each other. The target temperatures Tref may be set in advance or may be variable (e.g., ramped, dynamically controlled or otherwise adjusted).

Figures 9, 10:
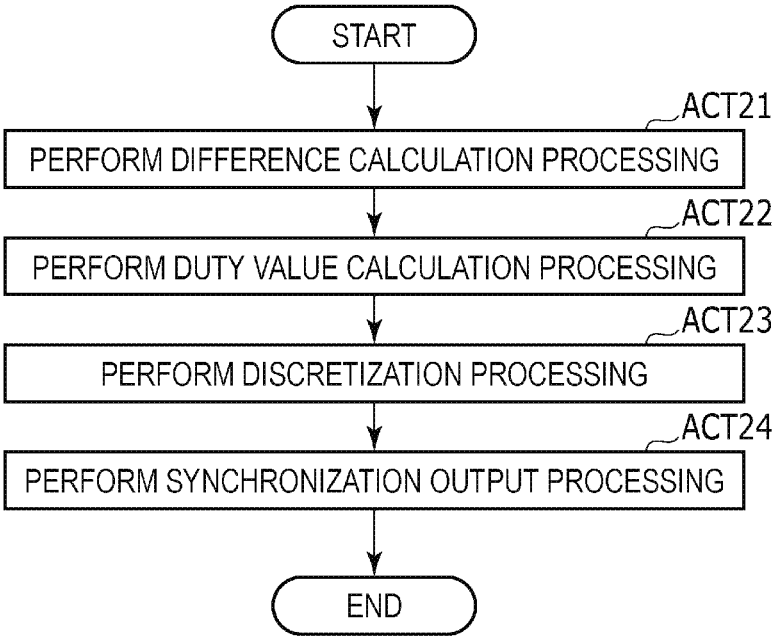
FIG. 9 is a diagram showing an example of a duty table.
FIG. 10 is a diagram showing an example of an operation of the control signal generation unit.

FIG. 9 is a diagram showing an example of a duty table.

The duty table is a table that can be expressed by a matrix of numbers according to a resolution. The duty table includes a plurality of duty patterns of numbers according to a resolution. The plurality of duty patterns are patterns corresponding to a plurality of duty values determined depending on a resolution. Each of the duty patterns indicates a pulse train configured by the number of values of "0" or "1" determined depending on a resolution. Here, "1" indicates a signal for electrical conduction (power on) and "0" indicates a signal for cut-off (power off). The number of instances of "1" varies depending on a duty value.

A duty table shown in FIG. 9 is a table of a 5% resolution. In this example, the duty table is a table that can be expressed by a matrix of 20×20 based on a 5% resolution. The duty table includes twenty different duty patterns in Table (0) to Table (19). The duty patterns Table (0) to Table (19) are patterns corresponding to twenty different duty values set depending on a 5% resolution. The duty pattern corresponds to a pulse train comprising twenty consecutive values (digits) of 0 or 1 determined depending on a 5% resolution.

FIG. 10 is a flowchart showing an operation of the control signal generation unit 85 in ACT 16.

The comparison unit 851 performs calculation processing for calculating a difference Tdif between a target temperature Tref and a correction temperature value WAE (ACT 21). For example, the comparison unit 851 calculates a value obtained by subtracting the correction temperature value WAE from the target temperature Tref as the difference Tdif. For example, the target temperature Tref is set to 130° C. The correction temperature value WAE is set to 125° C. The difference Tdif is 5° C. obtained by subtracting 125° C. from 130° C. The negative feedback unit 852 performs duty value calculation processing for calculating a duty value Dr on the basis of the difference Tdif (ACT 22). For example, the negative feedback unit 852 calculates the duty value Dr on the basis of the difference Tdif, a reference duty value Dref, and a gain K1. In this example, the negative feedback unit 852 may calculate the duty value Dr on the basis of Dr=Dref+Tdif×K1. For example, the reference duty value Dref is set to 60%. The gain K1 is set to 3. The difference Tdif is set to 5° C. The duty value Dr is 75% obtained by adding a product of 5 and 3 to 60.

In this manner, if the correction temperature value WAE is lower than the target temperature Tref, the negative feedback unit 852 increases a duty value more than the reference duty value Dref in order to increase the amount of electrical conduction to the heater 73. On the other hand, if the correction temperature value WAE is higher than the target temperature Tref, the negative feedback unit 852 decreases a duty value more than the reference duty value Dref in order to reduce the amount of electrical conduction to the heater 73.

The negative feedback unit 852 may change the duty value Dr on the basis of the magnitude of an AC voltage. For example, the negative feedback unit 852 calculates the duty value Dr on the basis of the difference Tdif, the reference duty value Dref, the gain K1, and a bias correction K2. The bias correction K2 is a correction value for correcting the duty value Dr in accordance with the magnitude of an AC voltage. The bias correction K2 may be stored in the memory 23 or may be stored in the control signal generation unit 85.

If an AC voltage is a standard voltage level (e.g., 100V), the bias correction K2 is 0. If the AC voltage is lower than the standard, the bias correction K2 is a positive value. This is because power obtained from an AC voltage lower than the standard is less than power obtained at the standard AC voltage in the case of the same duty value. Thus, if the AC voltage is lower than the standard, the duty value Dr is required to be increased. For example, if the AC voltage is 85 V, the bias correction K2 may be 0.8. The gain K1 may also be increased for the same reason.

On the other hand, if the AC voltage is higher than a standard, the bias correction K2 is a negative value. This is because power obtained from an AC voltage higher than the standard is greater than power obtained at the standard AC voltage in the case of the same duty value. Thus, if the AC voltage is higher than the standard, the duty value Dr is required to be decreased. For example, if an AC voltage is 120 V, the bias correction K2 may be −0.7. The gain K1 may also be decreased for the same reason.

In this example, the negative feedback unit 852 may calculate the duty value Dr on the basis of Dr=Dref+Tdif×K1+K2. An allowable voltage fluctuation range ±10% for an AC voltage may be reflected in the gain K1. The gain K1 may decrease if the AC power supply is in a range of +10% and may increase if the AC power supply is in a range of −10%. The negative feedback unit 852 need not use the bias correction K2. In this example, the negative feedback unit 852 changes the gain K1 in accordance with the magnitude of the AC voltage. The negative feedback unit 852 changes the gain K1 in accordance with an allowable voltage fluctuation range ±10% for the AC voltage.

The duty discretization unit 853 performs discretization processing for discretizing the duty value Dr obtained from the negative feedback unit 852 (ACT 23). For example, the duty discretization unit 853 converts the duty value Dr into a duty value Dd based on a 5% resolution. If the duty value Dr is less than 2.5 using a 5% resolution as an example, the duty value Dd is 0. If the duty value Dr is equal to or greater than 2.5 and less than 7.5, the duty value Dd is 5. If the duty value Dr is equal to or greater than 47.5 and less than 52.5, the duty value Dd is 50. This is the same for other ranges of the duty value Dr.

The AC zero cross synchronization unit 854 performs synchronization output processing for outputting a pulse Ps generated on the basis of the duty value Dd in synchronization with an AC voltage (ACT 24).

The generation of the pulse Ps will be described.

For example, the AC zero cross synchronization unit 854 selects a duty pattern from a duty table on the basis of the duty value Dd. If the duty value Dd is 0%, the AC zero cross synchronization unit 854 selects Table (0) (shown in FIG. 9) from the duty table as a duty pattern. If the duty value Dd is 5%, the AC zero cross synchronization unit 854 selects Table (1) (shown in FIG. 9) from the duty table as a duty pattern. If the duty value Dd is 50%, then the AC zero cross synchronization unit 854 selects Table (9) (shown in FIG. 9) from the duty table as a duty pattern. In this manner, the AC zero cross synchronization unit 854 can set a duty pattern by just selecting a duty pattern from the duty table. The duty table facilitates setting of a duty pattern.

The AC zero cross synchronization unit 854 generates a pulse Ps in accordance with the selected duty pattern. For example, the AC zero cross synchronization unit 854 generates pulse Ps to have a pulse train of "10101010101010101010" as shown in Table (9) if a duty of 50% is desired.

Synchronization output of pulse Ps to an AC voltage will be described.

For example, the AC zero cross synchronization unit 854 acquires the AC voltage cycle and determines whether the frequency of the AC voltage is 50 Hz or 60 Hz on the basis of the AC voltage cycle. Here, a case where the frequency of the AC voltage is 50 Hz is described as an example, but this is the same as in the case of 60 Hz.

The AC zero cross synchronization unit 854 outputs the pulse Ps in synchronization with a zero cross of the AC voltage. For example, if a duty of 50% is desired, the AC zero cross synchronization unit 854 switches signal values (e.g., high/low) of the pulse Ps to correspond to the pulse train of "10101010101010101010" with the value switches being synchronized to match with a zero cross of an AC voltage at 50 Hz. The AC zero cross synchronization unit 854 adjusts a time axis for outputting pulse Ps so as to synchronize to a zero cross of an AC voltage of 50 Hz. If the frequency of an AC voltage is 50 Hz, a zero cross of the AC voltage is repeated every 10 ms, that is, every 100 Hz cycle. The AC zero cross synchronization unit 854 outputs 1 at a timing of a zero cross of an AC voltage of 50 Hz. The AC zero cross synchronization unit 854 outputs "0" at a timing of the next zero cross after 10 ms from the output timing of "1". The AC zero cross synchronization unit 854 outputs "1" at a timing of the next zero cross after 10 ms from the output timing of "0". Thereafter, similarly, the AC zero cross synchronization unit 854 switches and outputs "1" or "0" at a timing of a zero cross of an AC voltage of 50 Hz.

The processing up to the selection of a duty pattern by the heater electric conduction control circuit 14 may be asynchronous with an AC voltage. The heater electric conduction control circuit 14 may perform processing on a cycle different from the cycle of the AC voltage. The processing up to the selection of a duty pattern by the heater electric conduction control circuit 14 may include processing in which the temperature estimation unit 81 estimates the temperature of the surface of the heat roller 71 and generates a temperature estimation result EST. The processing up to the determination of a duty pattern by the heater electric conduction control circuit 14 may include processing in which the high frequency component extraction unit 83 extracts a high frequency component HPF of the temperature estimation result EST. The processing up to the determination of a duty pattern by the heater electric conduction control circuit 14 may include processing in which the coefficient adding unit 84 corrects a temperature detection result Td on the basis of the high frequency component HPF and calculates a correction temperature value WAE. The processing up to the determination of a duty pattern by the heater electric conduction control circuit 14 may include processing in which the comparison unit 851 calculates a difference Tdif. The processing up to the determination of a duty pattern by the heater electric conduction control circuit 14 may include processing in which the negative feedback unit 852 calculates a duty value Dr. The processing up to the determination of a duty pattern by the heater electric conduction control circuit 14 may include processing in which the duty discretization unit 853 generates a duty value Dd on the basis of discretization of the duty value Dr. The processing up to the determination of a duty pattern by the heater electric conduction control circuit 14 may include processing in which the AC zero cross synchronization unit 854 selects a duty pattern from a duty table on the basis of the duty value Dd.

The image forming apparatus 1 includes the fixing device 21 including the heat roller 71 that heats a toner image formed on a medium to fix the toner image to the medium and the heater 73 that heats the heat roller 71, and a temperature control apparatus (e.g., the heater electric conduction control circuit 14). The heater electric conduction control circuit 14 supplies power to the heater 73 to control the temperature of the heat roller 71 to which heat is propagated from the heater 73. The heater electric conduction control circuit 14 includes the temperature estimation unit 81 that estimates the temperature of the heat roller 71 on the basis of electrical conduction to the heater 73. In addition, the heater electric conduction control circuit 14 includes the control signal generation unit 85 calculating a duty value Dr on the basis of a temperature estimation result EST, a temperature detection result Td of the heat roller 71 obtained by the temperature sensor 74, and a target temperature Tref, and outputting an electrical conduction pulse for controlling power to be supplied to the heater 73 on the basis of the duty value Dr.

In addition, the control signal generation unit 85 calculates a difference Tdif between a target temperature Tref and a correction temperature value WAE based on a temperature estimation result TES and a temperature detection result Td, and calculates a duty value Dr on the basis of the difference Tdif.

In addition, the control signal generation unit 85 selects a duty pattern from a table including a plurality of duty patterns on the basis of the duty value Dr and generates a pulse Ps on the basis of the selected duty pattern.

In addition, the control signal generation unit 85 outputs the pulse Ps in synchronization with a zero cross of an AC voltage.

With such a configuration, the temperature control apparatus can realize a simple feedback control which is effective in WAE control, and can increase the speed of feedback control. The temperature control apparatus can perform high-accuracy temperature control through WAE control and feedback control effective in the WAE control. Thereby, the temperature control apparatus can reduce the cost of the temperature sensor 74 and prevent overshoot, a temperature ripple, or the like from occurring.

The above-described temperature control apparatus can be applied to various equipment using heat and/or heaters other than an image forming apparatus 1. For example, the temperature control apparatus can be applied to a copying machine, a multifunction device, or a printing machine of a type that melts a toner with heat. The temperature control apparatus can also be applied to a furnace in which temperature is to be kept constant or gradually changed, or a single crystal material manufacturing machine in which crystals are pulled up and grown from a melting furnace. The temperature control apparatus can be applied to a color thermal printer that changes color development depending on applied temperature. The temperature control apparatus can be applied to a melting furnace for manufacturing alloys.

In the case of a copying machine or a color thermal printer, it is possible to expect an improvement in the quality of printing such as cleanness of printing and no change with time in color in spite of large quantity printing.

Regarding a melting furnace, temperature control can be precisely performed, and thus it is possible to expect an improvement in the yield of manufactured products, an improvement in crystal quality (a reduction in a crystal defect rate), an improvement in the performance of an alloy, and the like.

The various functions described for the above-described embodiments are not necessarily provided using dedicated hardware, but in some instances can be realized in software executed on a computer. In addition, certain functions may be configured may be provided in combinations of software and hardware.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A temperature control apparatus, comprising:

a temperature estimation circuit configured to estimate a temperature of a temperature control target based on electrical power supplied to a heater configured to heat the temperature control target;

a control signal generation unit configured to:

calculate a duty value for the heater based on an estimated temperature of the temperature control target received from the temperature estimation circuit, a detected temperature of the temperature control target from a temperature sensor, and a target temperature for the temperature control target, and output a pulse signal for controlling the electrical power supplied to the heater, the pulse signal being generated based on the calculated duty value;

a high frequency component extraction unit configured to extract a high frequency component from the estimated temperature of the temperature control target; and a coefficient adding unit configured to receive the high frequency component from the high frequency component extraction unit and the detected temperature from the temperature sensor and then correct the detected temperature on the basis of the high frequency component, wherein the corrected detected temperature is used for calculating the duty value.

2. The temperature control apparatus according to claim 1, wherein the control signal generation unit is configured to select a duty pattern from a table including a plurality of duty patterns on the basis of the calculated duty value, and the pulse signal is generated based on the selected duty pattern.

3. The temperature control apparatus according to claim 1, wherein the control signal generation unit is configured to output the pulse signal in synchronization with a zero cross of an AC voltage.

4. The temperature control apparatus according to claim 1, further comprising:

a power supply circuit configured to receive the pulse signal and supply electrical power to the heater according to the pulse signal.

5. The temperature control apparatus according to claim 4, wherein the power supply circuit supplies the electrical power to the heater as a direct current (DC) voltage.

6. The temperature control apparatus according to claim 1, wherein the control signal generation unit is configured to select a duty pattern from a duty table, the duty table being stored in a memory unit of the control signal generation unit, the duty pattern being selected from the duty table according to the calculated duty value.

7. The temperature control apparatus according to claim 1, wherein the temperature control target is a surface of a fixing device in an image forming apparatus.

8. The temperature control apparatus according to claim 1, wherein the heater is in a fixing device of an image forming apparatus.

9. The temperature control apparatus according to claim 1, wherein the heater is a lamp or an inductive heater.

10. An image forming apparatus, comprising:

a fixing device with a rotating body for heating a toner image on a medium and a heater for heating the rotating body;

a temperature control unit configured to supply electrical power to the heater to control a temperature of the rotating body; and a temperature sensor positioned to detect a temperature corresponding to the temperature of the rotating body, wherein the temperature control unit includes:

a temperature estimation circuit configured to estimate the temperature of the rotating body based on the electrical power supplied to the heater;

a control signal generation unit configured to:

calculate a duty value for the heater based on an estimated temperature of the rotating body received from the temperature estimation circuit, the detected temperature from the temperature sensor, and a target temperature for the rotating body, and output a pulse signal for controlling the electrical power supplied to the heater, the pulse signal being generated based on the calculated duty value;

a high frequency component extraction unit configured to extract a high frequency component from the estimated temperature of the rotating body; and a coefficient adding unit configured to receive the high frequency component from the high frequency component extraction unit and the detected temperature from the temperature sensor and then correct the detected temperature on the basis of the high frequency component, and the corrected detected temperature is used for calculating the duty value.

11. The image forming apparatus according to claim 10, wherein the control signal generation unit is configured to select a duty pattern from a table including a plurality of duty patterns on the basis of the calculated duty value, and the pulse signal is generated based on the selected duty pattern.

12. The image forming apparatus according to claim 10, wherein the control signal generation unit is configured to output the pulse signal in synchronization with a zero cross of an AC voltage supplied to the image forming apparatus.

13. The image forming apparatus according to claim 10, further comprising:

a power supply circuit configured to receive the pulse signal and supply electrical power to the heater according to the pulse signal.

14. The image forming apparatus according to claim 13, wherein the power supply circuit supplies the electrical power to the heater as a direct current (DC) voltage.

15. The image forming apparatus according to claim 10, wherein the control signal generation unit is configured to select a duty pattern from a duty table, the duty table being stored in a memory unit of the control signal generation unit, the duty pattern being selected from the duty table according to the calculated duty value.

16. The image forming apparatus according to claim 10, wherein the heater is a lamp or an inductive heater.

* * * * *